US008454821B2

(12) United States Patent
Chakrabarty et al.

(10) Patent No.: US 8,454,821 B2
(45) Date of Patent: Jun. 4, 2013

(54) METHOD AND SYSTEM FOR RECLAIMING WASTE HYDROCARBON FROM TAILINGS USING SOLVENT SEQUENCING

(75) Inventors: Tapantosh Chakrabarty, Calgary (CA); Ken N. Sury, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 226 days.

(21) Appl. No.: 12/871,552

(22) Filed: Aug. 30, 2010

(65) Prior Publication Data

US 2011/0210044 A1 Sep. 1, 2011

(30) Foreign Application Priority Data

Oct. 27, 2009 (CA) ..... 2682109

(51) Int. Cl.
*C10C 3/08* (2006.01)
*C10G 21/02* (2006.01)

(52) U.S. Cl.
USPC ..... 208/45; 208/390; 208/424; 208/428; 208/429; 208/435

(58) Field of Classification Search
USPC ..... 208/45, 428–435
See application file for complete search history.

(56) References Cited

U.S. PATENT DOCUMENTS

| | | | | |
|---|---|---|---|---|
| 5,968,349 | A | 10/1999 | Duyvesteyn et al. | |
| 7,357,857 | B2 | 4/2008 | Hart et al. | |
| 7,566,394 | B2 | 7/2009 | Koseoglu | |
| 7,998,342 | B2 * | 8/2011 | Duyvesteyn et al. | 208/390 |
| 8,257,580 | B2 * | 9/2012 | Duyvesteyn et al. | 208/390 |
| 2005/0197267 | A1 | 9/2005 | Zaki et al. | |
| 2006/0027488 | A1 * | 2/2006 | Gauthier | 208/309 |
| 2006/0196812 | A1 | 9/2006 | Beetge et al. | |
| 2007/0295640 | A1 | 12/2007 | Tan et al. | |
| 2008/0006561 | A1 | 1/2008 | Moran et al. | |
| 2010/0096297 | A1 * | 4/2010 | Stevens et al. | 208/45 |
| 2011/0062057 | A1 * | 3/2011 | Duyvesteyn | 208/390 |

FOREIGN PATENT DOCUMENTS

| | | |
|---|---|---|
| CA | 2645450 | 9/2007 |
| CA | 2614669 | 12/2008 |

* cited by examiner

*Primary Examiner* — Ellen McAvoy
(74) *Attorney, Agent, or Firm* — ExxonMobil Upstream Research Company—Law Department

(57) ABSTRACT

A method and system for extracting hydrocarbon products from waste tailings of a froth flotation unit and a paraffinic froth treatment process are provided. Bitumen and asphaltenes from the waste tailings are extracted using a serial addition of an aromatic solvent, followed by a polar-non-polar solvent. The method and system divert valuable hydrocarbons from tailings ponds. The hydrocarbon product can be used as a coating material or an emulsion fuel, for example.

13 Claims, 2 Drawing Sheets

METHOD AND SYSTEM FOR RECLAIMING WASTE HYDROCARBON FROM TAILINGS USING SOLVENT SEQUENCING

CROSS-REFERENCE TO RELATED APPLICATION

This application claims priority from Canadian Patent Application 2,682,109 filed 27 Oct. 2009 entitled METHOD AND SYSTEM FOR RECLAIMING WASTE HYDROCARBON FROM TAILINGS USING SOLVENT SEQUENCING, the entirety of which is incorporated by reference herein.

FIELD OF THE INVENTION

The present invention relates generally to bitumen extraction. More particularly, the present invention relates to a method for recovering hydrocarbons from paraffinic froth treatment (PFT) waste tailings used in bitumen extraction from mined oil sands.

BACKGROUND OF THE INVENTION

Oil sands are sand deposits which in addition to sand comprise clays, connate-water and bitumen. Depending on the depth of the deposit, bitumen may be recovered by mining or in situ thermal methods. Recovering the highly viscous bitumen from the oil sand poses numerous challenges, particularly since large quantities of heat and water are required to extract the bitumen. Further, most oil sand deposits are located in remote areas (such as, for example, in northeastern Alberta, Canada), which can contribute to increased costs for transportation and processing, especially in harsh weather conditions. Because of these challenges, obtaining a good yield of bitumen product from the oil sands is desired in order to reduce costs and waste.

Oil sand ore in a mining and extraction operation is typically processed using mechanical means and chemicals addition to separate the bitumen from the sands. One of the most common extraction techniques is hot water extraction. Hot water, air and process aids are added to the oil sands, resulting in the formation of an oil-rich froth product that "floats" or rises to form a distinct hydrocarbon phase that can be separated from the aqueous layer. The waste (sand, clay, rock, bitumen, water and chemicals) after processing in combination with the spent processing water and chemicals from the plant are termed as tailings.

The physical and chemical properties of tailings are dependent on the ore body being mined, processing circuits employed and the chemicals/reagents used prior to disposal. Tailings can be disposed of or stored using a variety of different methods. The overall oil sands extraction process, due to its size of operation, creates a large volume of waste requiring complex disposal arrangements. Tailings can include high quantities of bitumen/hydrocarbon product that is not extracted during typical bitumen extraction process. It would be desirable to recover a significant portion of this valuable material rather than having it remain in the waste tailings.

Typically, naphtha is used to dilute the bitumen froth before separating the product bitumen by centrifugation. This process is called naphtha froth treatment (NFT). Other processes use a paraffinic solvent (for example, a mixture of iso-pentane and n-pentane) to dilute the froth before separating the product bitumen by gravity. This process is called paraffinic froth treatment (PFT). A portion of the asphaltenes in the bitumen is rejected by design in the PFT process and this rejection is an important component in achieving solid and water levels in the product bitumen that are significantly lower than those in the NFT process. The advantages of the PFT over the NFT are in the better bitumen product quality (lower solids and water) and potential lower costs, because of the elimination of the cost-intensive centrifuges being used in the NFT process.

The PFT process comprises three distinct units: froth separation unit (FSU), solvent recovery unit (SRU) and tailings solvent recovery unit (TSRU). The tailings from TSRU can comprise about 6 wt % hydrocarbon in the form of asphaltenes and maltenes mixed with solvent (n-pentane and iso-pentane). The solvent concentration in the asphaltenes-solvent mixture is typically less than about 1 wt %. The disposal of the tailings with the solvent-diluted asphaltenes affects the economics of the bitumen extraction process.

U.S. Pat. No. 7,357,857 (2008), to Baker Hughes, Inc., describes a method of extracting bitumen from a bitumen froth using a paraffinic solvent. The method requires mixing the froth with the solvent for a sufficient period of time to dissolve the solvent, then subjecting the mixture to gravity or centrifugal separation for a sufficient period of time to separate the water, solids and asphaltenes. A separation enhancing additive is present, such as a polymeric surfactant.

U.S. Pat. No. 5,968,349 (1999), to BHP Minerals Int'l, describes a process for the extraction of bitumen from bitumen froth using a counter-current decantation circuit with a paraffinic solvent.

US Application 2005/0197267, published Sep. 8, 2005 in the name of Troxler Electronics Laboratories, Inc., describes water-soluble solvent compositions for removing petroleum residue from a substrate. The compositions comprise an aromatic ester, a cyclic terpene or a terpenoid, an odor-masking agent and a nonionic surfactant. The method contemplates using a spinning band distillation column.

US Application 2006/0196812, published Sep. 7, 2006, describes a method for diluting a bitumen froth with naphtha and contacting it with a zone settling aid such as a polyoxyalkylate block polymer.

Canadian Patent Application No. 2,645,450, published Sep. 13, 2007 in the name of Western Oil Sands (USA), Inc., describes a method of recovering asphaltenes from asphaltene-containing tailings using flotation separation and hydrophobic agglomeration separation.

Other methods and systems are described in the art, such as in U.S. Pat. No. 7,566,394 (Saudi Arabian Oil Company, 2009), US Patent Application No. 2008/0006561 (Moran et al., 2008), US Patent Application No. 2007/0295640 (Schlumberger Technology Corp., 2007), and Canadian Patent No. 2,614,669 (Imperial Oil Resources Limited, 2008).

There is a need to improve the reclaiming of the valuable hydrocarbon material from the tailings waste streams generated in a PFT process. There is also a need to recover the valuable hydrocarbon material from the tailings of the froth flotation step of the bitumen extraction process.

SUMMARY OF THE INVENTION

It is an object of the present invention to obviate or mitigate at least one disadvantage of previous froth treatment extraction systems and methods.

In a first aspect, the present invention provides a method of extracting a hydrocarbon product from a hydrocarbon-containing stream, comprising: a) adding a first solvent, comprising an aromatic solvent, to the stream to separate the stream into a hydrocarbon layer and an aqueous layer; b) adding a second solvent, comprising a mixture of a polar solvent and a non-polar solvent, to the hydrocarbon layer to separate the hydrocarbon product; and c) removing the hydrocarbon product from the hydrocarbon layer.

In further aspect, the present invention provides a system for extracting a hydrocarbon product from a hydrocarbon-containing bitumen stream, comprising: a) a first settling vessel for receiving the hydrocarbon-containing bitumen stream and for separating an intermediate hydrocarbon product therefrom; b) a second settling vessel for receiving the intermediate hydrocarbon product from the first settling vessel, for adding a first solvent, thereto to form a diluted intermediate intermediate hydrocarbon product, the first solvent comprising an aromatic solvent; and c) a third settling vessel for receiving the diluted intermediate hydrocarbon product from the second settling vessel, for adding a second solvent thereto to recover the hydrocarbon product from the diluted intermediate hydrocarbon product, the second solvent comprising a mixture of a polar solvent and a non-polar solvent.

Advantageously, the method and system of the present invention provide for the extraction of hydrocarbon product from tailings which would normally be sent to a tailings pond. The present method and system also allow for making useful products from the hydrocarbon recovered from the waste tailings. For example, three of these products may include a coating material, an emulsion fuel, or a feed to a refinery coker unit or a gasifier.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached figures, wherein.

DETAILED DESCRIPTION

Figure 1:
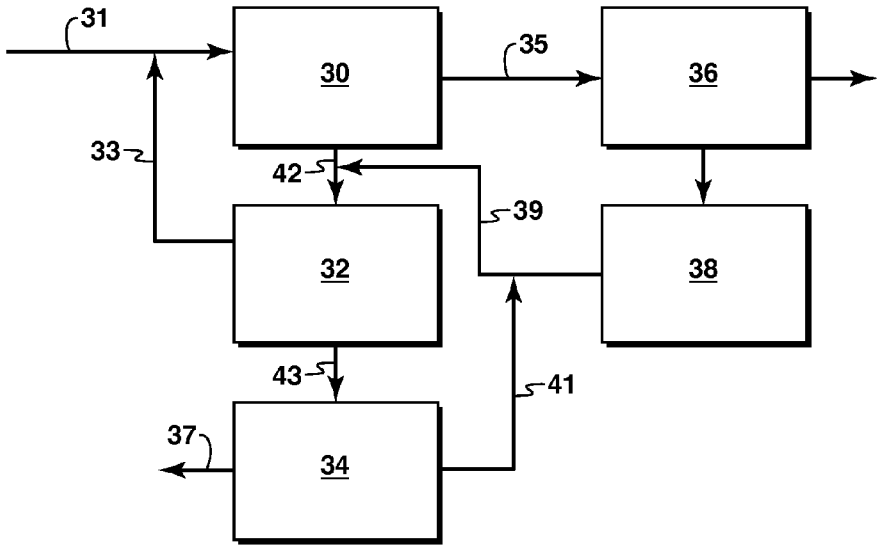
FIG. 1 (Prior Art)
FIG. 1 (prior art) shows a typical paraffinic froth treatment process.

Generally, the present invention provides a method and system for recovering hydrocarbon products from bitumen tailings.

In accordance with one aspect of the present invention, there is provided a method of extracting a hydrocarbon product from a hydrocarbon-containing stream, comprising: a) adding a first solvent, comprising an aromatic solvent, to the stream to separate the stream into a hydrocarbon layer and an aqueous layer; b) adding a second solvent, comprising a mixture of a polar solvent and a non-polar solvent, to the hydrocarbon layer to separate the hydrocarbon product; and c) removing the hydrocarbon product from the hydrocarbon layer.

In another aspect of the present invention there is provided a system for extracting a hydrocarbon product from a hydrocarbon-containing bitumen stream, comprising: a) a first settling vessel for receiving the hydrocarbon-containing bitumen stream and for separating an intermediate hydrocarbon product therefrom; b) a second settling vessel for receiving the intermediate hydrocarbon product from the first settling vessel, for adding a first solvent, thereto to form a diluted intermediate hydrocarbon product, the first solvent comprising an aromatic solvent; and c) a third settling vessel for receiving the diluted intermediate hydrocarbon product from the second settling vessel, for adding a second solvent thereto to recover the hydrocarbon product from the diluted intermediate hydrocarbon product, the second solvent comprising a mixture of a polar solvent and a non-polar solvent. The system can further comprise an evaporator for receiving the hydrocarbon product from the third settling vessel, evaporating the solvent and then adding an emulsifying surfactant thereto to form an emulsion fuel. The system can also comprise a fourth vessel for receiving the diluted hydrocarbon product from the third settling vessel to be used as a coating material.

In yet another aspect of the present invention there is provided a solvent comprising a a mixture of a polar solvent and a non-polar solvent for use in extracting a hydrocarbon product from a hydrocarbon-containing bitumen stream, the solvent comprising an alkane; a ketone R'COR" where R' and R" represent an alkyl group and are the same or different. As used herein, this solvent is referred to as the "PNP solvent" or the "second solvent".

As used herein, a "settling vessel" includes any suitable vessel for allowing materials added therein to separate, typically through the use of gravity. This can include gravity separation or using a means for mechanical separation, such as a centrifuge.

Ideally, the method and system can be used for recovering the waste hydrocarbon in the TSRU tailings by adding two solvents sequentially. The hydrocarbon-containing stream is bitumen waste tailings comprising asphaltenes and maltenes. The waste tailings can be obtained from paraffinic froth treatment of bitumen. The waste tailings can also be obtained from the froth flotation step of the bitumen extraction process.

The first solvent can be an aromatic solvent which is known to be an excellent solvent for asphaltenes and maltenes. The second solvent can be a mixture of a polar and a nonpolar (PNP) solvent, each of which separately is a poor solvent but in combination is surprisingly a good solvent for bitumen. One important feature of the PNP solvent is that it dissolves asphaltenes and maltenes at a much higher rate than an aromatic solvent. The PNP solvent typically has a much lower boiling point (36 to 57° C.) than typical aromatic solvents (111 to 144° C.).

The sequencing of a conventional aromatic solvent and novel PNP solvent can be used to recover hydrocarbon and produce useful hydrocarbon products from waste tailings. For example, three of these products are a coating material, an emulsion fuel, or a feed to a refinery coker unit or a gasifier.

A typical paraffinic froth treatment (PFT) process consists of three distinct units: froth separation unit (FSU), solvent recovery unit (SRU) and tailings solvent recovery unit (TSRU). An exemplary PFT process is shown in FIG. 1. In the FSU unit, the mixing of the solvent with the bitumen froth feed is carried out counter-currently in two stages: FSU-1 (30) and FSU-2 (32). Alternatively, the process could be operated with a single FSU.

In FSU-1 (30), the froth (31) is mixed with the solvent-rich oil stream (33) from the second stage (FSU-2, 32). The temperature of FSU-1 (30) is maintained at about 70° C. and the target solvent to bitumen ratio is about 2:1 (w/w). The overhead (35) from FSU-1 (30) is the diluted bitumen product and the bottom stream (42) from FSU-1 (30) is the tailings consisting of water, solids (inorganics), asphaltenes and some residual bitumen (maltenes). The residual bitumen from this bottom stream is further extracted in FSU-2 (32) by contacting it with fresh solvent in a 25:1 to 30:1 (w/w) solvent to bitumen ratio at about 90° C. The solvent-rich overhead (33) from FSU-2 (32) is mixed with the bitumen froth feed. The bottom stream (43) from FSU-2 (32) is the tailings consisting of solids, water, asphaltenes and residual solvent, the solvent (41) from which needs to be recovered in the TSRU (34) prior to the disposal of the tailings (37) in the tailings ponds. The solvent from the diluted bitumen overhead stream (35) from FSU-1 (30) is recovered in the SRU (36) and can be reused in the process (from solvent storage 38 via stream 39). The parameters identified herein are merely exemplary. It should be understood that other parameters may be used as desired.

Figure 2:
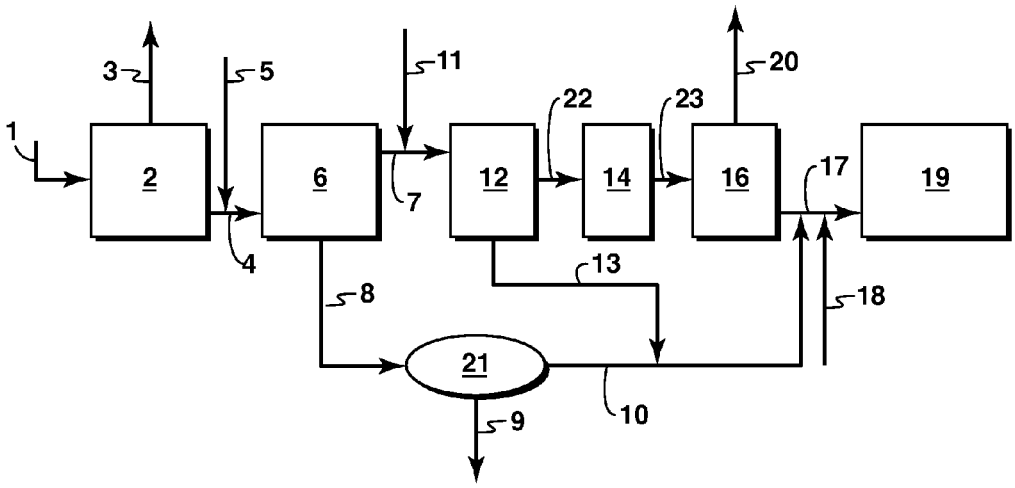
FIG. 2 shows a tailings extraction method and system in accordance with an embodiment of the present invention.

FIG. 2 illustrates one aspect of the method and system of the present invention in which the streams and vessels are identified. Except for any settling that may occur, the process may be continuous. The tailings (1) from the TSRU (34 in FIG. 1), comprising about 80 wt % water, 6.5 wt % total hydrocarbon with about 5.5 wt % asphaltenes, 0.5 wt % bitumen/maltenes and <0.5 wt % PFT process solvent, are allowed to settle in a first settler (2) into a top water stream to be recycled (3) and a bottom stream consisting of solids, water, asphaltenes and maltenes (4).

In one embodiment, an aromatic solvent is added (5) to the bottom stream (4) from the first settler (2) to dilute the asphaltenes and maltenes. The aromatic solvent may be any suitable solvent such as toluene, xylene or a mixture thereof. The mixture of solvent and the bottom stream is allowed to separate either by gravity in a second settler (6) or by centrifugation into a diluted hydrocarbon layer (7) and a water-plus-solids layer (8), termed herein as an aqueous layer. The water-plus-solids layer can be centrifuged (21) to separate the water from the solids (9). This water (10) can be reused to make an emulsion fuel.

As used herein, the "hydrocarbon layer" is a layer which typically comprises hydrocarbons as a predominant component, but which can comprise other materials such as, but not limited to, solids, other fines and water.

The aromatic solvent can be present in varying amounts. The ratio of aromatic solvent to asphaltenes plus maltenes in the tailings may vary from 10:90 to 50:50 (by volume). The ratio of toluene to xylene may vary from 0:100 to 100:0 (by volume). The ratio of PNP solvent to aromatic solvent plus hydrocarbon product may vary from 10:90 to 50:50 (by volume). Further, the ratio of polar to nonpolar solvent in the PNP solvent may vary from 10:90 to 90:10 (by volume).

To the top (hydrocarbon) layer of the diluted asphaltenes stream (7) is added a PNP solvent (11). Ideally, the PNP solvent should dissolve asphaltenes and maltenes at a much higher rate than the aromatic solvent. Its use minimizes the total addition of the higher boiling aromatic solvent. Exemplary PNP solvents include a mixture of alkanes (such as C3 to C10, for example which can be straight chained or branched), and ketones (R'COR" or R'COR", where R' and R" are the same or different and represent an alkyl group, thus forming ketones such as acetone, butanone, propanone or hexanone, or other suitable ketones), or any mixture of alkanes, ketones and/or alcohols (R'OH or R'C(OH)R", where R' and R" are as defined above, forming compounds which can be, for example, methanol, ethanol, propanol, isopropanol, butanol, iso-butanol, pentanol or iso-pentanol, etc.).

The ratio of PNP solvent to aromatic solvent plus asphaltenes/maltenes in the tailings may vary from 10:90 to 50:50 (by volume). The ratio of polar to nonpolar solvent in the PNP solvent may vary from 10:90 to 90:10 (by volume).

The aromatic solvent is added first to stream (4) because it is an effective solvent for asphaltenes and maltenes and its solubility in the water, which is present in stream (4) in large proportion, is low. The PNP solvent is added second to minimize loss of the polar component of the solvent in the water, as stream (7) has a relatively low level of water.

The PNP solvent can be used to partially or completely separate the hydrocarbon product from the stream. Ideally, the separation can be accelerated over using the aromatic solvent alone.

After mixing with the PNP solvent, stream (7) is allowed to settle in vessel (12). The bottom stream (13) from this vessel is primarily water comprising some fines and polar component of the PNP solvent. The solids from this stream can be separated by settling or centrifugation (not shown). The water comprising the polar component of the PNP solvent, which may act as a co-surfactant in the emulsification of the asphaltenes plus maltenes, can be used for making the emulsion fuel.

The supernatant (22) from vessel (12) is stored in a vessel (14) and is typically the solvent-diluted asphaltenes plus maltenes. Possible uses of this include as a fuel, as a coating material, as a refinery coker feed, or as a gasifier feed, although other uses may be contemplated.

In one example, the supernatant (22) from vessel (12) can be used as an emulsion fuel. In one exemplary embodiment, the solvent from the diluted asphaltenes and maltenes (23) from vessel (14) is recovered in an evaporator (16) as stream (20), and the hot asphaltenes and maltenes (17) are immediately mixed with water (10, 13) recovered in earlier steps. The temperature in evaporator (16) should be hot enough to boil off the high boiling solvents. An external surfactant (18) may be added to the mixture (of water, surfactant, asphaltenes and maltenes) which already contains a co-surfactant from the polar component of the PNP. The presence of the co-surfactant reduces the amount of the external surfactant required to make a stable emulsion. To apply shear energy needed to make the emulsion, a colloid mill or a set of static mixers may be used (not shown). The emulsion fuel can be stored in vessel (19).

As another example, the supernatant (22) can be used as a coating material. The recovered diluted asphaltenes plus maltenes (14) may be stored in a vessel (not shown), from where it can be used as is, or after some of the solvent has been evaporated, depending on the application. Some potential applications may include coating the exterior of buried pipelines, coating the bottom and sides of cemented tailings ponds, or undercoating of motor vehicles, for example. The lower boiling PNP in the coating material evaporates from the coating material allowing a fast-drying coating, while the higher boiling aromatic solvent allows time to apply the coat effectively.

In yet another example, the asphaltenes plus maltenes (14) can be used in a refinery as a feed to a coker unit to produce low molecular weight hydrocarbon gases, naphtha, light and heavy gas oils, and petroleum coke. The petroleum coke may be used as a fuel or as an anode in electrochemical cells. Alternatively, the asphaltenes plus maltenes may be used in a gasifier to make syngas (a mixture of CO and $H_2$) which may be combusted in internal combustion engines, used in fuel cells, or converted to a synthetic fuel through Fisher-Tropsch reaction.

The sequential addition of the two solvents minimizes the solvent requirements, especially of the higher boiling aromatic solvent, and allows the extraction of asphaltenes and maltenes at a much higher rate than the aromatic solvent alone. The lower boiling PNP evaporates faster than the aromatic solvent when the recovered asphaltenes and maltenes are used as a coating material. When used as an emulsion fuel, the lower boiling point solvent can be boiled off and recovered more easily prior to the asphaltenes and maltenes being emulsified. The polar component of the PNP also acts as a co-surfactant in the emulsification process. Hence, its presence in the asphaltenes and maltenes and the separated water reduces the amount of the external surfactant for preparing an emulsion fuel.

The ability of the PNP to dissolve bitumen faster from bitumen-coated blades, penetrating an oil sands matrix faster producing higher average oil rate than conventional solvents including toluene are illustrated by the following three examples.

Example 1

To demonstrate the bitumen dissolving power of the PNP solvent, the bottom 2 cm of four stainless steel blades were coated with unmeasured amount of Cold Lake bitumen. The bitumen dissolving power of four solvents were compared: PNP in 30:70 acetone to heptane solvent ratio, by volume, toluene (aromatic solvent), acetone (polar solvent) and heptane (nonpolar solvent). The blades for the PNP solvent and toluene demonstrations were each 22 mm wide, while the blade for the acetone test was 17 mm wide and that for the heptane was 20 mm wide. The difference in the blade widths did not appear to affect the conclusion of the experiment.

Each bitumen-coated blade was immersed in 100 mL of each solvent taken in a 120 mL bottle at room temperature (~22° C.) and the cleaning of the blades, in the absence of any stirring, by dissolution of bitumen was videotaped.

A stream of diluted bitumen running from the bottom of the blade to the bottom of the bottle was formed within four seconds of immersion of the coated blade into the PNP solvent. A narrower stream was formed after immersing the blade into the toluene. Three thin streaks of diluted bitumen were noted in the blade immersed in the heptane. No stream was formed in the acetone solvent.

The blade in the PNP was cleaned in less than 7 minutes, while the blade in toluene was cleaned in 11 minutes, showing that the PNP solvent is faster than toluene in dissolving bitumen.

After seven minutes of exposure, the PNP solvent coated blade appeared essentially free of bitumen (except for some brown spots), while the toluene coated blade was still covered with some bitumen. The heptane-coated blade was still covered with a significant amount of bitumen. The acetone-coated blade did not show any appreciable dissolution of bitumen. Therefore, the PNP solvent, in accordance with the present invention, was the quickest of the four solvents tested in dissolving bitumen from the blades. Although tested herein with bitumen, the PNP solvent may similarly be particularly efficacious in dissolving asphaltenes from tailings containing asphaltenes and maltenes.

Example 2

Mined Athabasca oil sands were homogenized by kneading at the Imperial Oil Resources (IOR) facility. Into a 50-mL graduated glass (Pyrex™) cylinder, 21.2 g of the homogenized oil sands were packed to a depth of 4 cm using a round-bottomed solid metallic rod (8 mm diameter). A fine-mesh screen was attached to the open bottom of the graduated cylinder to allow drainage of the solvent-diluted bitumen while retaining the sands.

To the top of the packed oil sands was poured 22-mL each of the four solvents: n-pentane, acetone, toluene and PNP solvent (n-pentane to acetone ratio 70:30 by volume). In four separate experiments, the rate of penetration of each solvent into oil sands matrix was measured by recording the penetrated solvent depth visible from the transparent glass wall of the graduated cylinder vs. time until the first drop of oil was produced. The experiment was conducted at room temperature (21° C.) and atmospheric pressure with the cylinder top capped with an aluminum foil to prevent solvent loss by evaporation. An average penetration rate was calculated by dividing the height of the bed by the time at which the first drop of diluted oil was produced.

Figure 3:
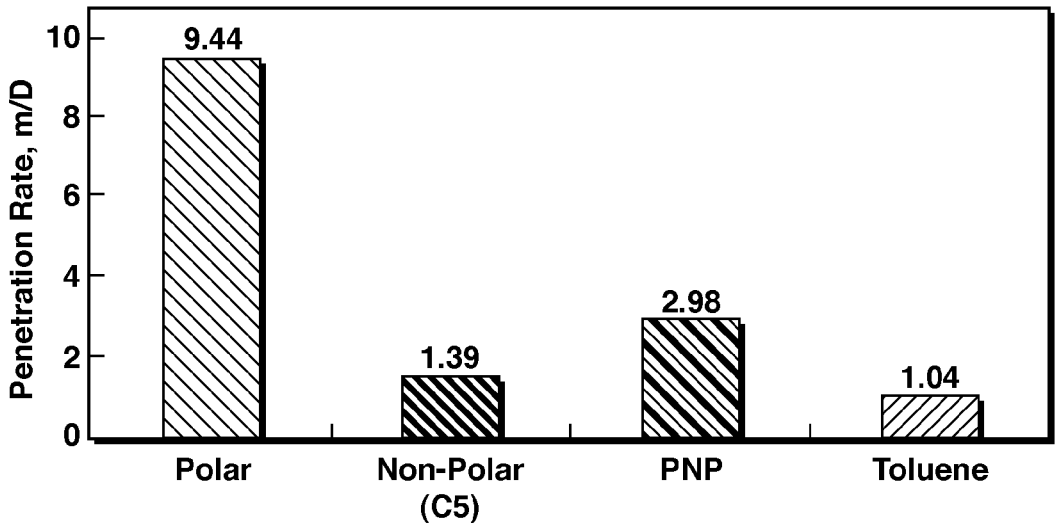
FIG. 3 shows solvent penetration rates of different solvents into oil sands.

FIG. 3 compares the penetration rate of the four solvents. The penetration rate of the PNP solvent is 2.85 times higher than that of toluene and two times higher than that of n-pentane. The polar solvent (acetone) shows the highest penetration rate, but as will be shown later it also extracts the least amount of bitumen.

For a solvent to be economic in extracting bitumen or asphaltenes plus maltenes from tailings, its speed of penetration as well as the total bitumen recovery are both important factors. In other words, the desired solvent should extract more bitumen (or asphaltenes plus maltenes) in less time. The example below compares the bitumen extraction efficiencies of the four solvents mentioned earlier.

Example 3

To compare the bitumen extraction efficiencies of the four solvents, the tests in Example 2 were continued by collecting all the solvent-diluted bitumen draining out from the oil sands pack in a pre-weighed aluminum dish placed inside a fume hood. The solvent from the bitumen was evaporated in an oven at 80° C. to a constant weight and the total amount of solvent-free bitumen was reported as g bitumen extracted per kg of oil sands.

For the nonpolar solvent (n-pentane), the solvent-diluted produced bitumen initially was very thick and dark-coloured (i.e. bitumen-rich) and with time it became progressively solvent-rich. The time to complete the solvent-diluted bitumen drainage in with pentane was 70.8 min. The total solvent-free bitumen recovered by n-pentane from the Athabasca oil sands was 58.20 g per kg of oil sands.

For the polar solvent (acetone), the produced diluted bitumen right from the start was solvent-rich and very light coloured. The time to complete the solvent drainage in this experiment was 23.4 min. The oil extracted by acetone was also different from the oil produced by pentane and other solvents in that its colour was distinctly orange, compared to the dark colour of the oil extracted by others. This suggests that acetone may be able to extract only the polar components of the bitumen. The total solvent-free bitumen recovered by acetone from the Athabasca oil sands was only 16.93 g per kg of oil sands, which is 3.7 times lower than that by pentane. The lower oil production by the polar solvent is not unexpected as it is known to be a poor solvent for bitumen.

For the toluene, the bitumen production time is 152 minutes which is 3.5 times higher than that for the PNP solvent. Toluene, however, produces 114.48 g bitumen per kg oil sands, the highest of all the four solvents tested.

For the PNP solvent, the produced oil was initially very thick and progressively became thinner with time. The time to complete the solvent drainage in this experiment was 43.6 min, starting from the time the solvent contacted the oil sands. This is 1.6 times lower than the time needed to complete the production with n-pentane.

The total solvent-free bitumen recovered from the Athabasca oil sands by the PNP solvent was 98.96 g/kg oil sands, which is 1.8 times higher than that by the non-polar solvent, n-pentane. Oil recovery economics is typically dependent on both the amount of total oil recovered and the total time of production. As such, the oil production per unit kg oil sands was divided by the total time of production to obtain the average oil rate, expressed as g oil/kg oil sands per min.

Figure 4:
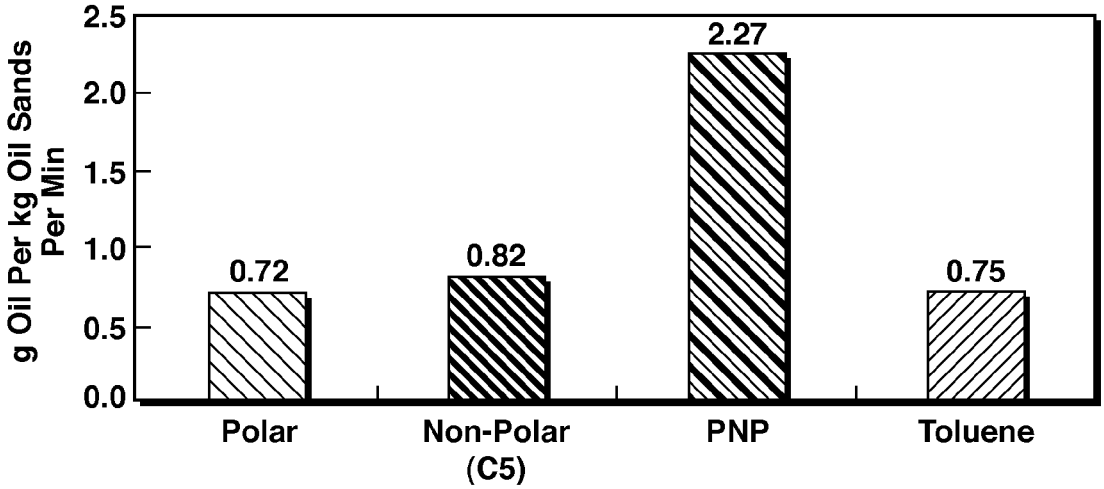
FIG. 4 shows average oil recovery rates using different solvents.

As shown FIG. 4, the average bitumen extracted per unit weight of oil sands per unit time is the highest for PNP at 2.27 and 0.82 for pentane, 0.72 for the polar solvent (acetone) and 0.75 for toluene. Thus the PNP solvent, on the average, extracts 2.8 times more bitumen per unit time and per unit weight of the oil sands than the non-polar solvent, n-pentane. Compared to toluene, the PNP solvent extracts 3.02 times more bitumen per unit time and per unit weight of the oil sands.

The above examples show that while an aromatic solvent (such as toluene) dissolves bitumen from a bitumen-coated blade and can extract the most bitumen from an Athabasca oil sands matrix, the PNP solvent of the present invention is the quickest in dissolving bitumen and extracting the most bitumen per unit time per unit weight of the tailings. Hence, the method in accordance with the present invention, i.e., first using the aromatic solvent to dissolve asphaltenes and aid separation of water and hydrocarbon, and then using the PNP solvent to take advantage of its superior effectiveness and quickness in dissolving bitumen and extracting the most asphaltenes plus maltenes per unit time per unit weight of the tailings, is particularly advantageous for reclaiming hydrocarbon wastes from PFT tailings.

The above-described embodiments of the present invention are intended to be examples only. Alterations, modifications and variations may be effected to the particular embodiments by those of skill in the art without departing from the scope of the invention, which is defined solely by the claims appended hereto.

The invention claimed is:

1. A method of extracting a hydrocarbon product from a hydrocarbon-containing stream, comprising:

a) adding a first solvent, comprising an aromatic solvent, to the hydrocarbon-containing stream to separate the stream into a hydrocarbon layer and an aqueous layer;

b) adding a second solvent, comprising a mixture of a polar solvent and a non-polar solvent, to the hydrocarbon layer to separate the hydrocarbon product; and c) removing the hydrocarbon product from the hydrocarbon layer.

2. The method of claim 1 wherein the hydrocarbon-containing stream is bitumen waste tailings comprising asphaltenes.

3. The method of claim 2 wherein the waste tailings are obtained from paraffinic froth treatment of bitumen or from froth flotation during a bitumen extraction process.

4. The method of claim 1 wherein the aromatic solvent is toluene, xylene or a mixture thereof.

5. The method of claim 1 wherein the first solvent is a mixture of toluene and xylene having a concentration ratio of 1:100 to 100:1, by volume.

6. The method of claim 1 wherein the ratio of the aromatic solvent to the hydrocarbon product is 10:90 to 50:50, by volume.

7. The method of claim 1 wherein the ratio of the second solvent to the aromatic solvent plus the hydrocarbon product is from 10:90 to 50:50, by volume.

8. The method of claim 1 wherein in the second solvent, the ratio of the polar to the nonpolar solvent is from 10:90 to 90:10, by volume.

9. The method of claim 1 wherein the second solvent comprises (i) an alkane and a ketone R'COR" where R' and R" represent an alkyl group and are the same or different; or (ii) an alkane and an alcohol R'OH or R'C(OH)R" where R' and R" represent an alkyl group and are the same or different; or (iii) an alkane, a ketone R'COR" where R' and R" represent an alkyl group and are the same or different, and an alcohol R'OH or R'C(OH)R" where R' and R" represent an alkyl group and are the same or different.

10. The method of claim 9 wherein the alkane is a C3 to C10, straight or branched, alkane.

11. The method of claim 9 wherein the ketone is acetone, butanone, propanone or hexanone.

12. The method of claim 9 wherein the alcohol is methanol, ethanol, propanol, isopropanol, butanol, iso-butanol, pentanol or iso-pentanol.

13. The method of claim 1 wherein the hydrocarbon product is used as a coating material, an emulsion fuel, or as a feed to a refinery coker unit or a gasifier.

* * * * *